US005239328A

United States Patent [19]

Wernicke et al.

[11] Patent Number: 5,239,328

[45] Date of Patent: Aug. 24, 1993

[54] MACHINE FOR DEVELOPING PHOTOGRAPHIC MATERIAL

[75] Inventors: Ubbo Wernicke, Roesrath-Kleineichen; Günther Schnall, Eching; Günter Röckle, Gummersbach, all of Fed. Rep. of Germany

[73] Assignee: Agfa-Gevaert Aktiengesellschaft, Leverkusen, Fed. Rep. of Germany

[21] Appl. No.: 837,368

[22] Filed: Feb. 14, 1992

[30] Foreign Application Priority Data

Mar. 1, 1991 [DE] Fed. Rep. of Germany ..... 4106546

[51] Int. Cl.[5] ..... G03D 3/08

[52] U.S. Cl. ..... 354/320

[58] Field of Search ..... 354/320, 323, 324, 319, 354/321, 331

[56] References Cited

U.S. PATENT DOCUMENTS 5,040,013 8/1991 Kurokawa et al. ..... 354/322

*Primary Examiner*—D. Rutledge

*Attorney, Agent, or Firm*—Connolly & Hutz

[57] ABSTRACT

A machine for developing photographic material comprising more than one tank and means for continuously conveying photographic material through the development machine, reduces the entraining of chemicals from one tank to the next, when the conveying distance is 40 to 200 cm.

2 Claims, 1 Drawing Sheet

MACHINE FOR DEVELOPING PHOTOGRAPHIC MATERIAL

Figure 1:
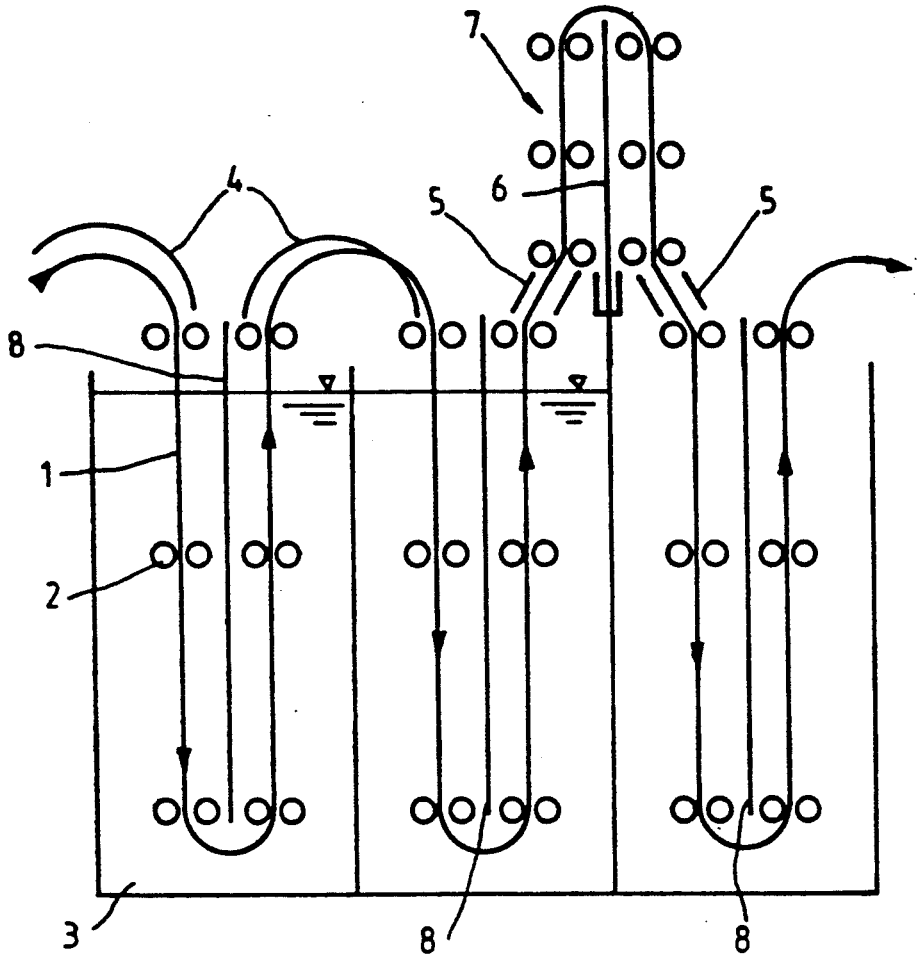

In order to produce photographic images, photosensitive material after exposure are subjected to a development process, e.g.:

| | |
|---|---|
| Black and white materials: | Developing |
| | Fixing |
| | Washing |
| | Drying |
| Colour materials: | Developing |
| | Washing |
| | Bleaching |
| | Washing |
| | Fixing |
| | Washing |
| | Drying |

The photographic material is treated with the various solutions in machines.

To this end the photographic material, when in the form of rolls, is conveyed, e.g. entrained by a belt, through the various tanks containing the processing solutions.

In another method, also applied to the case of sheet material, the photographic material is conveyed through the solutions by driven pairs of rollers. The pairs of rollers are usually combined in groups in a rack which can be taken out of the tank.

The aim of designers hitherto has been to reduce the conveyance and reversing of photographic material from one tank to the next to the shortest possible distance, in order to maximise the time during which the photographic material remained in the chemical bath, and minimise the time outside the chemical bath, which is regarded as having no or adverse effect on processing.

Also, many developing and reversal-bath solutions are so sensitive to oxidation that prolonged reversal times can result in serious sensitometric disadvantages.

In recent years, however, this problem has been eliminated by considerable advances in protection of photographic solutions against oxidation.

One disadvantage, however, is the considerable entrainment of chemicals from one treatment tank to the next, due to the short reversing distance.

The object of the invention is substantially to avoid entrainment of chemicals.

This problem is solved to a surprisingly great extent by surprisingly simple means.

The invention relates to a development machine comprising more than one tank and means for continuously conveying the photographic material through the development machine, where the conveying distance from one tank to another is 40–200 cm, preferably 60–120 cm. Along this distance or section, the photographic material is freed from adhering chemicals by dripping and, if required, by adding a small amount of water, which is not discharged in the waste water but returned to the tank from which the photographic material has just come. The amount of added water is preferably 30 to 150 ml/m$^2$. The photographic material is conveyed more particularly at a speed of 1 to 20 m/min.

The conveying section is embodied by substantially the same rack used to convey the photographic material through the tank, except that the racks (shortened if required) are now rotated through 180° and disposed on the wall between two tanks.

This device substantially prevents chemicals from being entrained into the next tank. The dilution caused by the added water is compensated by adding suitably highly concentrated regenerators or pure chemicals in solid form for rejuvenation.

FIG. 1 is a diagram of a development machine comprising a conventional conveying section and a conveying section according to the invention.

Photographic material (1) is conveyed by rollers (2) through tanks (3). The rollers (2) are secured in a rack (8) which divides each tank into two halves.

A conventional conveying section, protected by a baffle plate (4), is provided between the first and second tank, whereas a conveying section according to the invention is provided between the second and the third tank and comprises a rack (6) and pairs of rollers disposed on the wall between the two tanks. Water can be supplied at the place marked (7).

EXAMPLE 1

The efficiency of the device according to the invention can be demonstrated as follows:

A commercial colour photographic paper was developed in a developer having the following composition:

| | |
|---|---|
| CD 3 | 10 g/l |
| Sodium sulphite | 1 g/l |
| Benzyl alcohol | 10 ml/l |
| Polyglycol | 20 ml/l |
| Monopotassium phosphate | 17 g/l |
| pH 11.4, adjusted with KOH. | |

After development, the photographic material was washed in a water tank and then bleachfixed, washed and dried.

The pH in the washing tank rose through entrainment of adhering developer.

It is therefore possible, by measuring the pH in the water tank downstream of the developer, to determine the amount of entrainment thereof, if the system is calibrated.

Calibration

| | |
|---|---|
| 1 l of water without colour developer (CD): | pH=7.1 |
| with 0.1 wt. % CD 3 | 7.6 |
| with 0.5 wt. % CD 3 | 8.1 |
| with 1.0 wt. % CD 3 | 8.3 |
| with 5.0 wt. % CD 3 | 10.1 |
| with 10.0 wt. % CD 3 | 10.9 |
| with 20.0 wt. % CD 3 | 11.3 |

a) (Comparison)

7 m$^2$ of commercial colour paper in the form of 8.9 cm wide rolls was developed in a development machine.

| | |
|---|---|
| Rate of paper advance | 1.5 m/min |
| Developer temperature | 38° C. |
| Development time | 45 sec |
| Developer | As before |

After the developer, the paper ran through an 8-liter tank filled with water. No fresh water was added. The conveying distance from the developing tank to the washing tank was 15 cm.

After the 7 $m^2$ had passed through, the measured pH in the washing tank was 10.3.

In accordance with the "calibration table" this corresponds to a content of more than 5 wt. % CD 3 in the water. The calculated entrainment is about 60 ml/$m^2$.

b) (As per the invention)

The procedure was as in a) except that the photographic material was conveyed over the transverse section according to the invention (55 ccm long) and was uniformly supplied with 60 ml water/$m^2$ in the rising part of the section.

The material was only then supplied to the washing tank.

After 7 $m^2$ had passed through, the measured pH in the water tank was 8.3.

This corresponds to a concentration of about 1 wt. % CD 3 in the water. By means of the invention, therefore, the entrainment was reduced by about 80%.

EXAMPLE 2 a) (Comparison)

The same photographic material as in Example 1 was conveyed through a bleachfixing bath.

Composition

| | |
|---|---|
| Ammonium iron EDTA | 50 g/l |
| Ammonium thiosulphate | 110 g/l |
| Sodium sulphite | 25 g/l |
| pH 6.5 | |

After bleachfixing, the material was immediately supplied to a 8-liter washing tank. The conveying distance from the bleachfixing bath level to the water level was 15 cm.

After 10 $m^2$ of colour paper had been processed, a sample was taken from the water bath and the thiosulphate content was found by analysis to be 9.5 g/l.

b) (As per the invention)

The paper was conveyed over a conveying section of 55 cm as in Example 1b) and, at the rising part, was uniformly treated with 70 ml water per $m^2$.

The material was then run into the water tank (contents 8 l). After 10 $m^2$ had been processed, a sample was taken and the thiosulphate content was determined, the result being 2.1 g/l. The device according to the invention therefore reduced entrainment by at least a factor of 4.

In practice, the water used for "pre-cleaning" the photographic material is advantageously taken from the next downstream water tank.

We claim:

1. A machine for developing photographic material comprising at least two baths arranged for successively processing said photographic material and means for continuously conveying the photographic material from one bath to another bath, wherein the improvement comprises means adapted to convey said photographic material through a conveying section at a first bath and a second bath; and comprising means mounted on said machine at said conveying section arranged to extend in an upward direction from said baths, and arranged for conveying the processed material between baths from said first bath to said second bath through a distance of from 40 to 200 cm., said conveying means providing means for bending the processed material in the conveying section into a generally inverted U-shape consisting of a rising section, a bight and a descending section between the exit from one bath and the entrance to another bath, and said machine having means for supplying water to the processed material at the rising section, wherein the processed material may be freed of adhering chemicals.

2. A development machine according to claim 1 characterized in that the water supplied at the rising section of the inverted U-shaped conveying section is returned to the tank.

* * * * *